US009072396B1

(12) United States Patent
Lazarus

(10) Patent No.: US 9,072,396 B1
(45) Date of Patent: Jul. 7, 2015

(54) ANTIMICROBIAL SCREENING RUNNER AND MAT

(75) Inventor: Cynthia Lazarus, Morton Grove, IL (US)

(73) Assignee: BELLAMAT LLC, Dover, DE (US)

( * ) Notice: Subject to any disclaimer, the term of this patent is extended or adjusted under 35 U.S.C. 154(b) by 915 days.

(21) Appl. No.: 12/732,574

(22) Filed: Mar. 26, 2010

Related U.S. Application Data

(60) Provisional application No. 61/165,007, filed on Mar. 31, 2009.

(51) Int. Cl.

| | |
|---|---|
| ***B32B 33/00*** | (2006.01) |
| ***B32B 27/36*** | (2006.01) |
| ***A47G 27/02*** | (2006.01) |
| ***D06N 7/00*** | (2006.01) |

(52) U.S. Cl.
CPC ..... *A47G 27/02* (2013.01); *D06N 7/0005* (2013.01)

(58) Field of Classification Search
CPC ... D06N 7/0005; D06N 7/0039; D06N 7/006; D06N 2209/16; D06N 2209/1671; D06N 2213/068; B32B 2471/04; B32B 3/02; B32B 7/12; B32B 27/36; B32B 33/00; B32B 2307/714; B32B 2307/7145; D06M 2200/00; D06M 23/005; A47G 27/02; A47G 27/0206
USPC ..... 428/86, 96, 88; 442/123, 286, 394
See application file for complete search history.

(56) References Cited

U.S. PATENT DOCUMENTS

| | | | | |
|---|---|---|---|---|
| 4,110,504 | A * | 8/1978 | Hull et al. | 428/97 |
| 5,024,840 | A * | 6/1991 | Blakely et al. | 424/404 |
| 6,219,876 | B1 * | 4/2001 | Blum | 15/215 |
| 7,757,457 | B2 * | 7/2010 | Zah et al. | 52/747.11 |
| 8,048,507 | B2 * | 11/2011 | Townsend et al. | 428/100 |
| 8,220,221 | B2 * | 7/2012 | Gray et al. | 52/747.11 |
| 2002/0040092 | A1 | 4/2002 | Siddiqui et al. | |
| 2004/0043686 | A1 | 3/2004 | Batdorf | |
| 2004/0076792 | A1 * | 4/2004 | Green et al. | 428/96 |
| 2005/0053644 | A1 | 3/2005 | Salemi et al. | |
| 2005/0160549 | A1 * | 7/2005 | Dean | 15/215 |
| 2005/0177957 | A1 * | 8/2005 | Long | 8/115.51 |
| 2005/0226914 | A1 | 10/2005 | Cottrell et al. | |
| 2005/0227895 | A1 | 10/2005 | Ghosh et al. | |
| 2005/0249791 | A1 | 11/2005 | Hobbs et al. | |
| 2006/0110999 | A1 | 5/2006 | McElreath | |

(Continued)

FOREIGN PATENT DOCUMENTS

| | | | |
|---|---|---|---|
| CN | 201384361 Y | * | 1/2010 |
| CN | 201641490 U | * | 11/2010 |

(Continued)

OTHER PUBLICATIONS

Google translation of CN 201719012 U, published Jan. 2011.*

(Continued)

*Primary Examiner* — Cheryl Juska
(74) *Attorney, Agent, or Firm* — Clark Hill PLC

(57) ABSTRACT

A runner or mat for use in a screening area includes a carpet, an anti-microbial agent coating the carpet, a film having an anti-microbial agent, and an adhesive adhering the film to the anti-microbial treated carpet. The runner or mat can have indicia, such as an outline of a pair of feet, soles of shoes or advertising, provided thereon. The runner or mat protects people from foot infections when walking barefoot or with socks through the screening area.

10 Claims, 4 Drawing Sheets

(56) References Cited

U.S. PATENT DOCUMENTS

| | | | | |
|---|---|---|---|---|
| 2006/0223962 | A1 | 10/2006 | Getman et al. | |
| 2006/0240217 | A1 | 10/2006 | Foss et al. | |
| 2006/0246149 | A1 | 11/2006 | Buchholz et al. | |
| 2007/0054819 | A1* | 3/2007 | Li et al. | 510/101 |
| 2007/0141125 | A1 | 6/2007 | Bourdelais et al. | |
| 2007/0222633 | A1* | 9/2007 | Blum et al. | 340/815.4 |
| 2007/0298209 | A1 | 12/2007 | Kohlman et al. | |
| 2008/0033026 | A1 | 2/2008 | Zullo et al. | |
| 2008/0043087 | A1 | 2/2008 | Cowan | |
| 2008/0050577 | A1* | 2/2008 | Gilder et al. | 428/317.1 |
| 2008/0095829 | A1 | 4/2008 | Hartman et al. | |
| 2008/0193496 | A1* | 8/2008 | Gabbay | 424/404 |
| 2008/0226584 | A1 | 9/2008 | Krishnan | |
| 2009/0274868 | A1* | 11/2009 | Hellman et al. | 428/123 |
| 2009/0311499 | A1* | 12/2009 | Hickey et al. | 428/219 |
| 2010/0173120 | A1* | 7/2010 | McGill | 428/95 |
| 2010/0173121 | A1* | 7/2010 | Mull et al. | 428/96 |
| 2010/0285298 | A1* | 11/2010 | Gilder et al. | 428/313.3 |
| 2011/0052662 | A1* | 3/2011 | Nakano et al. | 424/443 |
| 2011/0189423 | A1* | 8/2011 | Townsend et al. | 428/58 |

FOREIGN PATENT DOCUMENTS

| | | | |
|---|---|---|---|
| CN | 201719012 U | * | 1/2011 |
| DE | 1900494 A1 | * | 8/1970 |
| FR | 2830258 A1 | * | 4/2003 |
| FR | 2853323 A1 | * | 10/2004 |

OTHER PUBLICATIONS

Google translation of CN 201641490 U, published Nov. 2010.*

Google translation of CN 201384361 Y, published Jan. 2010.*

Print out of 3M Material Safety Data Sheet for 3M (TM) Double Coated Tape 9609; Dated Jul. 17, 2006; 6 Pages.

Print out from www.Monopanel.com of "For Custom Membrane Switch Technology" from Monopanel Technologies, Inc.; Printed Sep. 26, 2008; 4 Pages.

Print out of Safety Data Sheet from autotype; Revised on Apr. 1, 2002; 4 Pages.

Print out of Frequently Asked Questions from www.macdermidautotype.com; Dated Jul. 2007 2 Pages.

Print out of Typical Data for Autotex AM from www.macdermidautotype.com; Dated Jul. 2007 3 Pages.

Print out of Autoflex AM Product Overview from from www.macdermidautotype.com; Copyright 2008; 1 Page.

Print out of Shoes: New Airport Health Hazard "Taking your shoes off at airport security checkpoints exposes your feet to fungus and injury" from http://www.rnedicinenet.com; Copyright 1996-2005; 4 Pages.

* cited by examiner

ANTIMICROBIAL SCREENING RUNNER AND MAT

This application claims the domestic benefit of U.S. provisional application Ser. No. 61/165,007 filed on Mar. 31, 2009.

FIELD OF THE INVENTION

This invention is generally directed to an antimicrobial runner and mat for use in an screening area, such an airport screening area, a sporting arena screening area, a courthouse screening area or the like.

BACKGROUND OF THE INVENTION

In today's world of air travel in the United States, it is encouraged that commercial passengers remove their shoes prior to passing through a primary screening at a primary security checkpoint in order to speed the screening process. The shoes and any carry-on luggage are separated from the passenger and are passed through an X-ray machine. Passengers must pass through a metal detector and may walk a considerable distance without their shoes through the primary security checkpoint. Quite often, the passenger will not be wearing socks and will be forced to walk through the primary security checkpoint in his or her bare feet.

Some passengers are subject to a secondary screening at a secondary security checkpoint. In the secondary screening, the passenger is taken into a separate area and is hand checked and/or screened using a hand held metal detecting wand. If the passenger had not already removed their shoes during their pass through the primary security checkpoint, the passenger is required to remove their shoes for this secondary screening. If the passenger is required to undergo secondary screening, the passenger cannot retrieve their carry-on luggage until after the secondary screening. As a result, the passenger is either bare foot or has socks on during this secondary screening.

It is known to provide a two foot by six foot runner which has been treated with an antimicrobial agent at a primary security checkpoint. The antimicrobial agent inhibits growth of microbes, such as viruses and fungi (Athlete's foot), which can be easily transmitted by passengers walking without shoes through a primary security checkpoint, and therefore the runner protects passengers from foot infections as they traverse through the primary security checkpoint. The runner has a marking prominently displaying that the runner is treated with an antimicrobial agent, which increases passenger confidence in removing their shoes during their passage through the primary security checkpoint. The marking is provided on the runner by adhering a non-antimicrobial label to the runner. The label therefore does not protect the passengers against foot infections.

In the secondary security checkpoint, it is known to provide a two foot by three foot mat that has not been treated with an antimicrobial agent. The mat has a pair of colored soles of shoes painted thereon for the passenger to stand upon during the secondary screening. The paint used to paint the colored feet has not been treated with an antimicrobial agent. As a result, the mat and paint provide possible transmission points for foot infections. Moreover, the paint on the mat degrades to the point of cracking over time because of use.

The present invention provides a runner and a mat which overcomes the problems presented in the prior art and which provides additional advantages over the prior art, such advantages will become clear upon a reading of the attached specification in combination with a study of the drawings.

SUMMARY OF THE INVENTION

A runner or mat for use in an screening area is provided. The screening area may be an airport screening area, a sporting arena screening area, a courthouse screening area or the like. The runner or mat includes a carpet, an anti-microbial agent coating the carpet, a film including an anti-microbial agent, and an adhesive adhering the film to the anti-microbial treated carpet. The runner or mat can have indicia, such as an outline of a pair of soles of feet, shoes or advertising, provided thereon. The runner or mat protects people walking on the runner or mat from foot infections when walking barefoot or with socks through the screening area.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
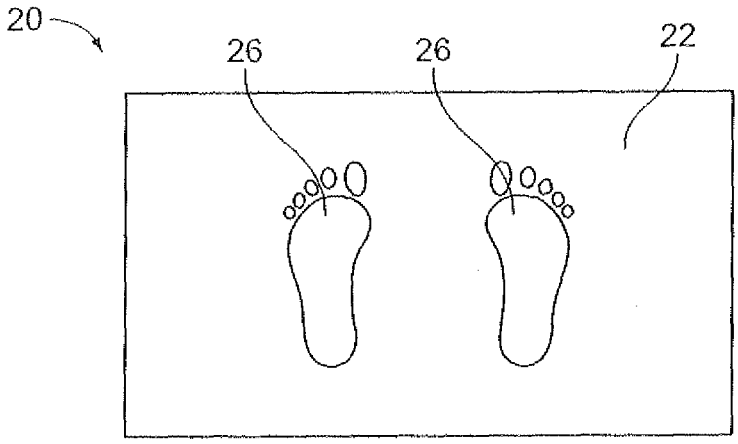
FIG. 1 is a top plan view of a first embodiment of a runner or a mat which incorporates the features of the present invention.
Figure 2:
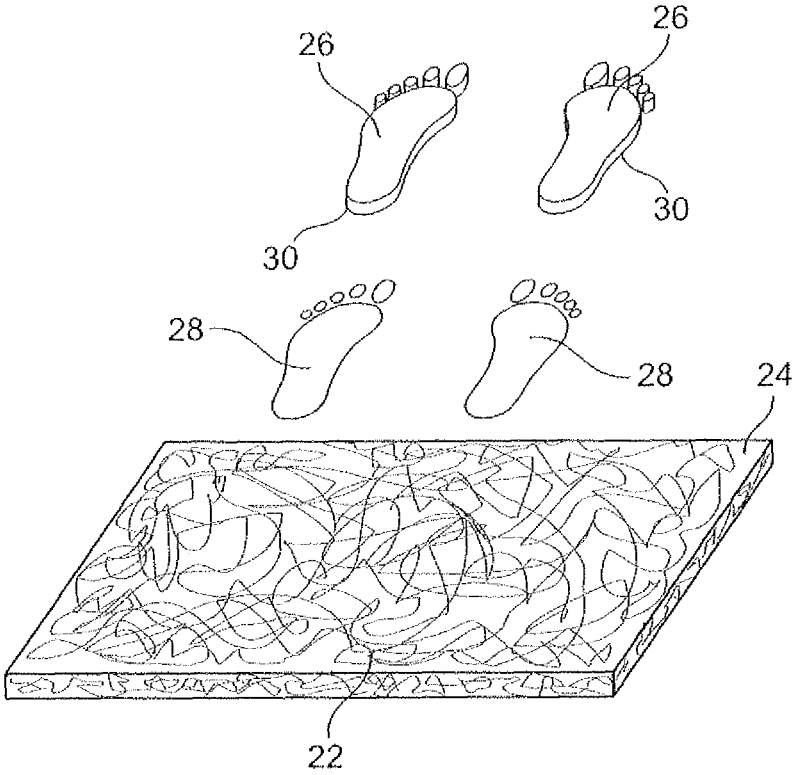
FIG. 2 is an exploded perspective view of the runner or the mat of FIG. 1.
Figure 3:
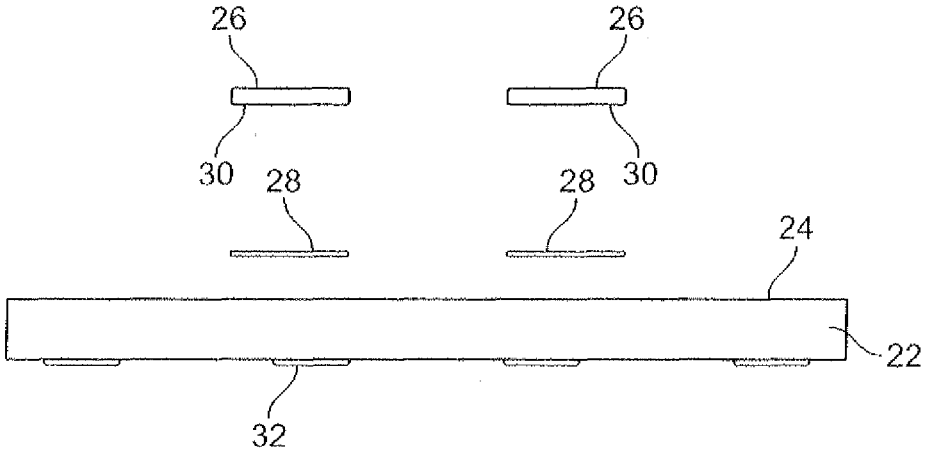
FIG. 3 is an exploded side elevational view of the runner or the mat of FIG. 1.
Figure 4:
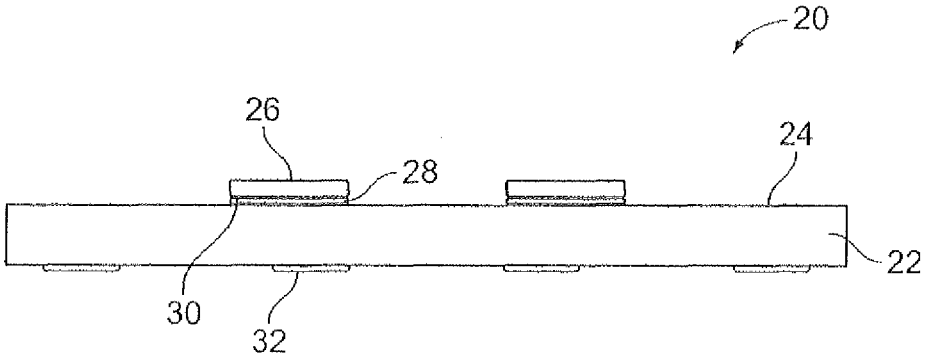
FIG. 4 is a side elevational view of the runner or the mat of FIG. 1.
Figure 5:
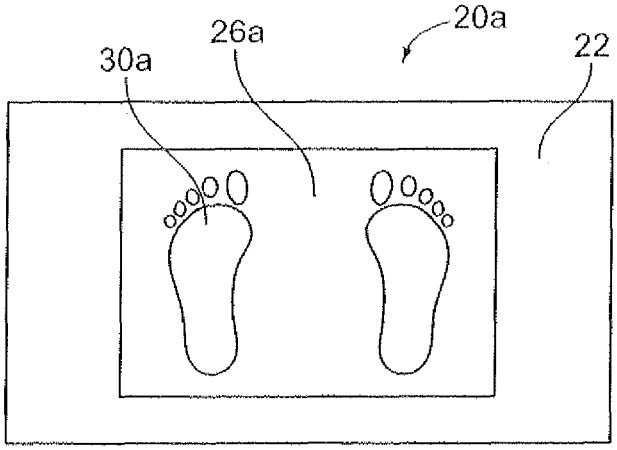
FIG. 5 is a top plan view of a second embodiment of a runner or a mat which incorporates the features of the present invention.
Figure 6:
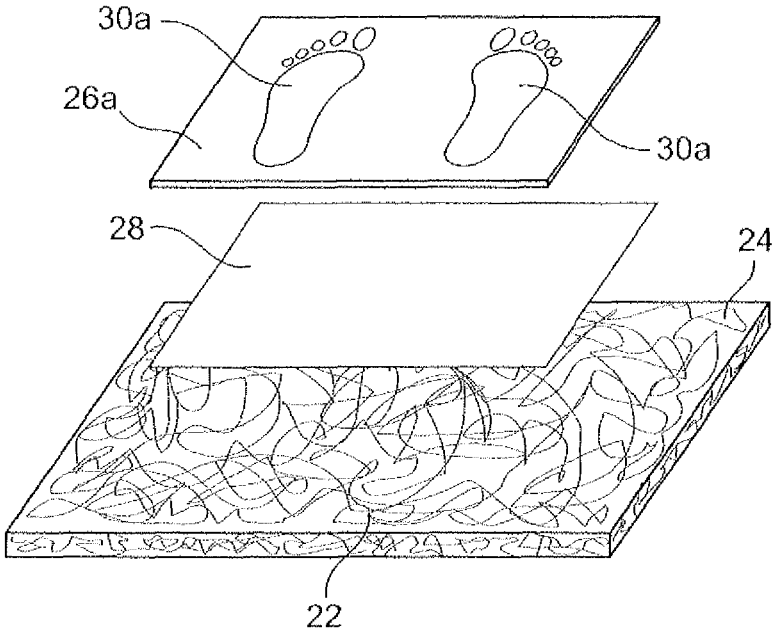
FIG. 6 is an exploded perspective view of the runner or the mat of FIG. 5.
Figure 7:
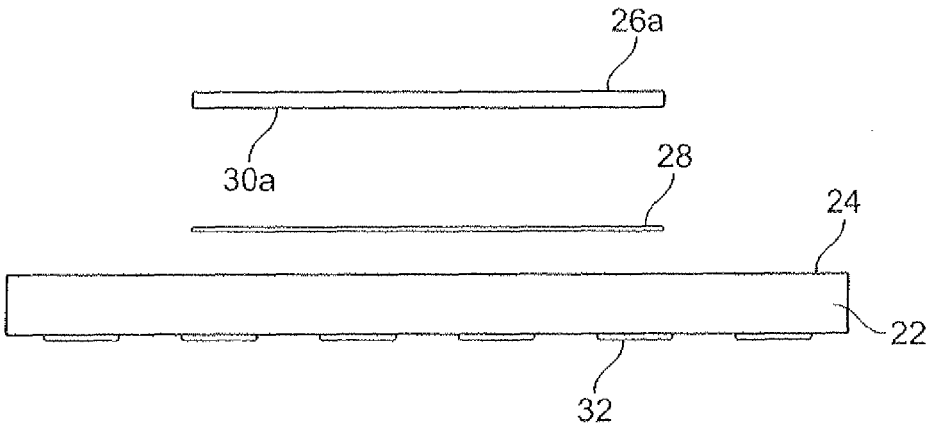
FIG. 7 is an exploded side elevational view of the runner or the mat of FIG. 5.
Figure 8:
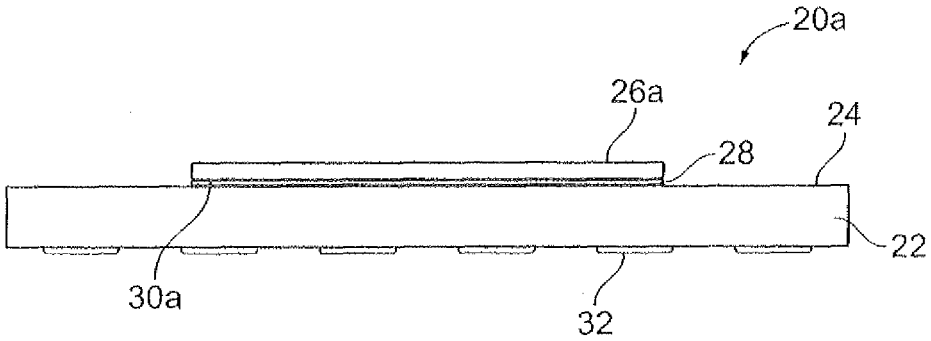
FIG. 8 is a side elevational view of the runner or the mat of FIG. 5.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 9:
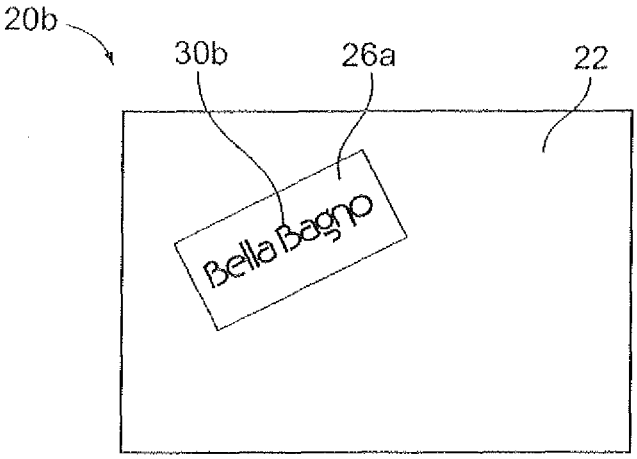
FIG. 9 is a top plan view of an alternate runner or mat which incorporates the features of the present invention.

A runner or mat 20, 20*a*, 20*b* for use in a screening area is provided. The screening area may be an airport screening area, a sporting arena screening area, a courthouse screening area or the like. A first embodiment of the runner or mat 20 is shown in FIGS. 1-4, a second embodiment of the runner or mat 20*a* is shown in FIGS. 5-8, and a third embodiment of the runner or mat 20*b* is shown in FIG. 9. The runner or mat 20, 20*a*, 20*b* protects the feet of persons walking thereon from foot infections when the person walks barefoot or with socks through the screening area.

Attention is invited to the first embodiment of the runner or mat 20 shown in FIGS. 1-4. The runner or mat 20 includes an anti-microbial treated carpet 22, a film 26, and an adhesive 28 adhering the film 26 to the anti-microbial treated carpet 22.

The carpet 22 has a coating 24 provided thereon which is formed of an anti-microbial agent. The carpet 22 is formed of a typical durable material, such as post-consumer recycled beverage bottles (for example that sold under the trademark GREEN SMART® which is owned by Beaulieu Group, LLC), wool, nylon, olefin, acrylic and polyester, having a backing on its bottom surface. Preferably, a non-skid surface 32 is applied to the backing. The top surface of the carpet 22 has the coating 24 applied thereto by conventional known means, such as by spraying, such that the carpet 22 is impregnated with the coating 24. An example of a suitable antimicrobial agent is sold under the trademark ULTRA-FRESH® by Kroy International Inc. The antimicrobial agent does not replace normal cleaning practices.

The film 26 is formed of a transparent polyester which has an antimicrobial agent provided on the top surface of the film 26, or distributed evenly throughout the polyester. The top surface of the film 26 may be textured. The bottom surface of the film 26 is coated with a colored ink receptive primer so that a printed ink which forms the indicia 30 can be provided thereon. To form the indicia 30, ink may be screen-printed or digitally-printed onto the film 26. Thereafter, the printed ink is cured in a known manner. Such a film 26 is sold by Macdermid Autotype Limited Corporation under the trademark AUTOTEX® AM by Macdermid Autotype Limited. The antimicrobial agent in the film 26 is a broad-spectrum antimicrobial agent, commonly sold under the trademark MICROBAN® by Microban Products Company, which is effective against the most common bacteria that causes odors, stains and product degradation. The antimicrobial agent does not replace normal cleaning practices.

The bottom surface of the film 26 which has the indicia 30 thereon is attached to the top surface of the anti-microbial treated carpet 22 by the adhesive 28. An example of a suitable adhesive 28 is manufactured by 3M Company under the product name 3M® Double Coated Tape 9609. As a result, the indicia 30 is sandwiched between the anti-microbial treated carpet 22 and the film 26 and the indicia 30 is protected from wear since the indicia 30 will not contact the feet of a person walking on the runner or mat 20. As shown in FIGS. 1-4, two such films 26 are attached to the anti-microbial treated carpet 22 and the films 26 cover only a portion of the top surface of the carpet 22.

Attention is invited to the second embodiment of the runner or mat 20*a* shown in FIGS. 5-8. The components of the runner or mat 20*a* are identical to that of the first embodiment, except in this second embodiment, the indicia 30*a* is an outline of a pair of feet or soles of shoes, which are provided on a single film 26*a*.

Attention is invited to the third embodiment of the runner or mat 20*b* shown in FIG. 9. The components of the runner or mat 20*b* are identical to that of the second embodiment, except in this third embodiment, the indicia 30*b* on the film 26*a* is advertising material.

The indicia 30, 30*a* can take a variety of forms such as a pair of yellow feet, yellow soles of shoes, wording which states that the runner or mat 20, 20*a* is a "Disposable Antimicrobial Floor Mat" and/or shows that the runner or mat 20, 20*a* is a GREEN SMART® carpet. The film 26*b* with the indicia 30*b* that is advertising can be can be used alone or in combination with other films 26, 26*a*, such as those shown in FIGS. 1-8. This would allow for space for advertising material in the screening areas, while still ensuring that the runner or mat 20, 20*a*, 20*b* is completely anti-microbial.

If the film 26, 26*a* becomes worn prior to the carpet 22 becoming worn, the film 26, 26*a* can be removed and replaced with another like formed film 26, 26*a*. This will lengthen the use of the carpet 22. In addition, instead of using ink provided on the film 26, 26*a* to form the indicia 30, 30*a*, 30*b*, the film 26, 26*a* can be formed as a colored film to form the indicia 30, 30*a*, 30*b*.

While preferred embodiments of the present invention are shown and described, it is envisioned that those skilled in the art may devise various modifications of the present invention without departing from the spirit and scope of the appended claims.

The invention claimed is:

1. A runner or mat for use in a security screening area comprising:

a carpet comprising a material having a top surface and a bottom surface, said material being impregnated with an anti-microbial agent, the top surface of the carpet comprises a single plane;

a transparent film including an anti-microbial agent, said film having a top surface and a bottom surface;

ink printed on said bottom surface of said transparent film, said ink forming indicia; and an adhesive adhering said bottom surface of said transparent film to said top surface of said carpet.

2. A runner or mat for use in a security screening area as defined in claim 1, wherein said indicia is an outline of a pair of feet.

3. A runner or mat for use in a security screening area as defined in claim 1, wherein said ink is screen-printed or digitally-printed on said transparent film.

4. A runner or mat for use in a security screening area as defined in claim 1, wherein said indicia is advertising material.

5. A runner or mat for use in a security screening area as claim 1, wherein said transparent film is formed of polyester.

6. A runner or mat for use in a security screening area as defined in claim 1, further including a non-skid material provided on said bottom surface of said carpet.

7. A runner or mat for use in a security screening area as defined in claim 1, wherein said transparent film can be removed from said carpet and replaced with another film.

8. A runner or mat for use in a security screening area as defined in claim 1, wherein said material is formed of one of post-consumer recycled beverage bottles, wool, nylon, olefin, acrylic and polyester.

9. A runner or mat for use in a security screening area comprising:

a carpet comprising a material formed of one of post-consumer recycled beverage bottles, wool, nylon, olefin, acrylic and polyester and having a top surface and a bottom surface, said material lying impregnated with an anti-microbial agent, the top surface of the carpet comprises a single plane;

a transparent polyester film including an anti-microbial agent, said film having a top surface and a bottom surface;

ink screen-printed or digitally-printed on said bottom surface of said transparent polyester film to form indicia thereon, said indicia being at least one of an outline of a pair of feet and advertising;

an adhesive adhering said bottom surface of said transparent polyester film to said top surface of said carpet; and a non-skid material provided on said bottom surface of said carpet.

10. A runner or mat for use in a security screening area as defined in claim 9, wherein said transparent polyester film can be removed from said carpet and replaced with another film.

* * * * *